US008985043B2

(12) United States Patent
Eschen

(10) Patent No.: US 8,985,043 B2
(45) Date of Patent: Mar. 24, 2015

(54) SAIL FURLING STICKS

(71) Applicant: Eric L. Eschen, Oakland, CA (US)

(72) Inventor: Eric L. Eschen, Oakland, CA (US)

( * ) Notice: Subject to any disclaimer, the term of this patent is extended or adjusted under 35 U.S.C. 154(b) by 22 days.

(21) Appl. No.: 13/717,368

(22) Filed: Dec. 17, 2012

(65) Prior Publication Data

US 2014/0014014 A1 Jan. 16, 2014

Related U.S. Application Data

(60) Provisional application No. 61/577,596, filed on Dec. 19, 2011.

(51) Int. Cl.

| | |
|---|---|
| ***B63H 9/04*** | (2006.01) |
| ***B63H 9/10*** | (2006.01) |
| ***B63H 9/06*** | (2006.01) |

(52) U.S. Cl.

CPC ..... *B63H 9/04* (2013.01); *B63H 9/1092* (2013.01); *B63H 9/0642* (2013.01)

USPC ..... 114/102.15; 114/104

(58) Field of Classification Search

CPC .. B63H 9/1042; B63H 9/1092; B63H 9/0642; B63H 9/04

USPC ..... 114/90, 102.1, 102.15, 102.18, 104, 114/105, 106, 107, 108, 112, 204

See application file for complete search history.

(56) References Cited

U.S. PATENT DOCUMENTS

| | | | | |
|---|---|---|---|---|
| 4,280,431 | A | 7/1981 | Sofen | |
| 4,347,799 | A | 9/1982 | Moriarty | |
| 4,633,798 | A | 1/1987 | Skinner et al. | |
| 4,741,281 | A * | 5/1988 | Doyle | 114/102.15 |
| 4,838,192 | A | 6/1989 | Stevenson, IV et al. | |
| 4,844,136 | A | 7/1989 | Vavlitis | |
| 5,076,187 | A * | 12/1991 | Robinson | 114/105 |
| 5,181,477 | A * | 1/1993 | Harken et al. | 114/39.21 |

OTHER PUBLICATIONS

International Search Report and Written Opinion dated Feb. 19, 2013 in International Patent Application No. PCT/US2012/070368.

* cited by examiner

*Primary Examiner* — Lars A Olson
*Assistant Examiner* — Anthony Wiest
(74) *Attorney, Agent, or Firm* — Vierra Magen Marcus LLP

(57) ABSTRACT

A system is disclosed for stowing a sail of a sail boat. The system may include a furling stick, and ribs extending therefrom, for gathering the sail upon lowering of the sail. The system may further include leech sticks mounted on the sail for defining segments at which the sail folds upon stowing of the sail against the furling stick.

20 Claims, 8 Drawing Sheets

SAIL FURLING STICKS

PRIORITY

The present application claims priority to U.S. Provisional Patent Application No. 61/577,596, entitled "Sail Furling Sticks," filed Dec. 19, 2011.

BACKGROUND

The sail furling sticks system is designed for furling and stowing of a sailboat's mainsail on the boom. Sail furling sticks are used in lieu of other main sail stowing systems that are available such as: Lazy Jacks, Stack-packs, Dutchman, In-Mast or In-Boom stow systems. The design and use of the sail furling sticks does not compromise or interfere with the design or use (such as hoisting, setting or shaping) of the mainsail.

DETAILED DESCRIPTION

Figure 1:
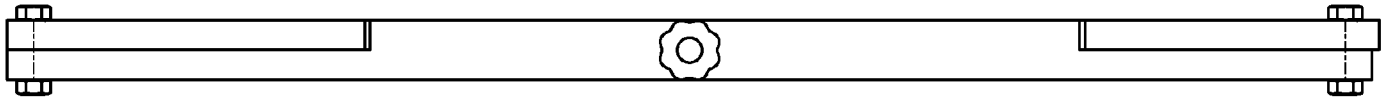
FIG. 1 is a top view of a sail furling stick.
Figure 2:
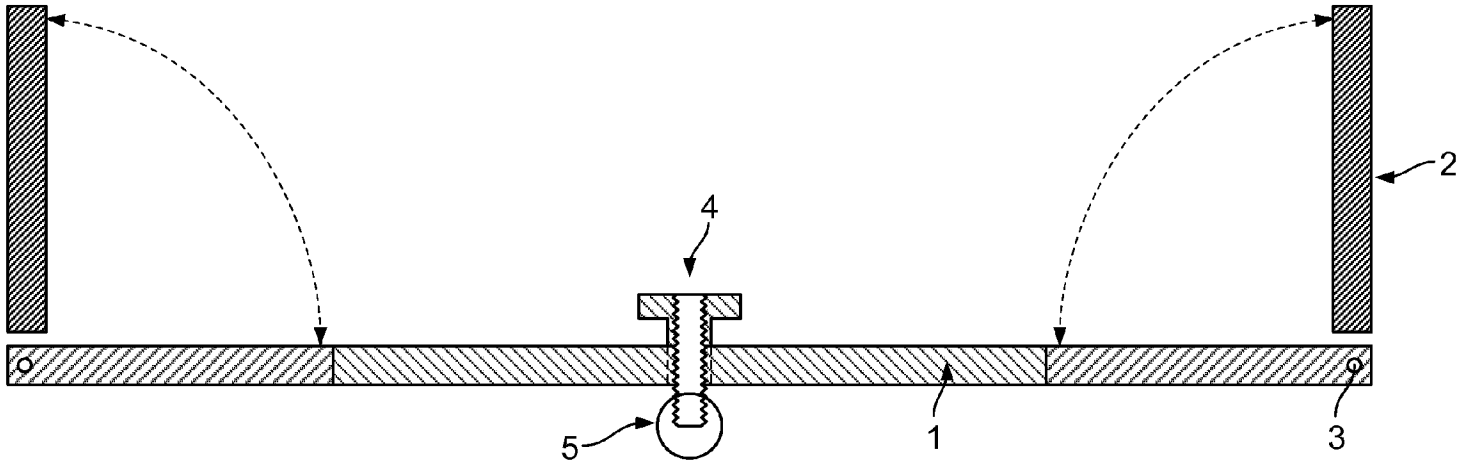
FIG. 2 is a side view of a sail furling stick.
Figure 4:
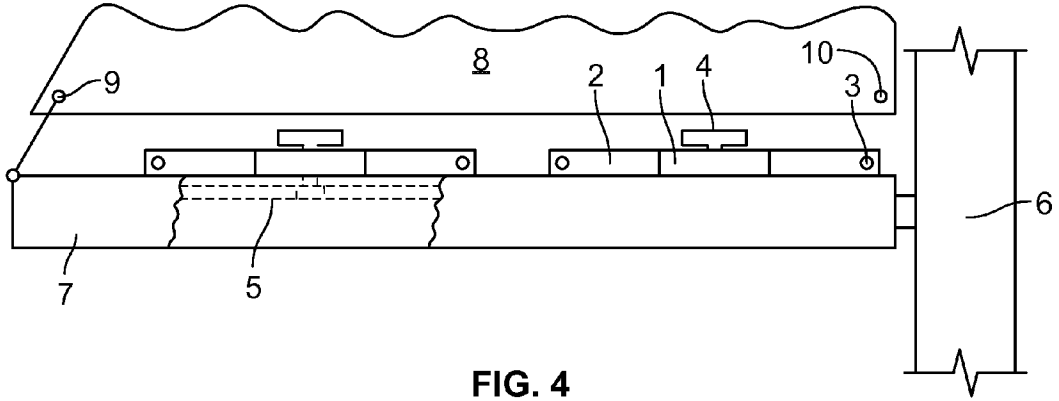
FIG. 4 is a side view of the sail furling stick in a stowed position.
Figure 5:
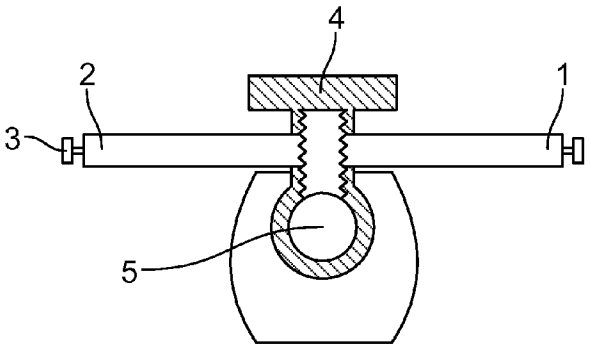
FIG. 5 is a cross-sectional edge view through a boom and furling stick in a stowed position.
Figure 3:
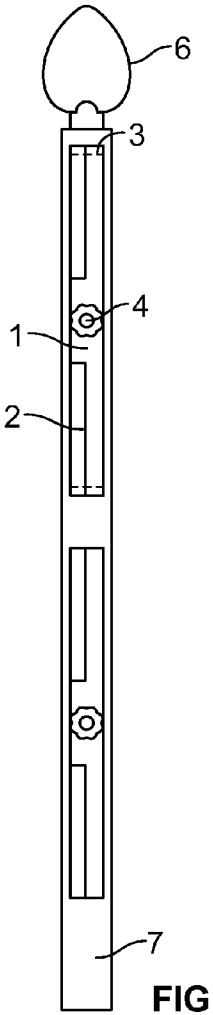
FIG. 3 is a top view of the sail furling stick with an adjustable gathering rib in stowed position.

When designing a mainsail for use with stowing systems such as Stack-packs, Dutchman, In-mast or In-boom stow systems, the design of the sail is modified to accommodate these systems. Therefore main sail performance is compromised to facilitate sail furling.

Sail Furling Sticks 1 are independent of the main sail 8. The mainsail 8 design does not need to be modified to accommodate the use of Sail Furling Sticks 1 to furl and stow the main sail 8. Mainsails 8 can be designed to sail for maximum performance.

The design of the Sail Furling Sticks 1 eliminates the following 'use' problems encountered by other types of mainsail stowing systems.

Hoisting: Where Lazy Jacks or other types of guide lines are used, as the mainsail is being raised the sail and lazy jacks flog and often a mainsail batten will foul on a lazy jack line further complicating the hoisting operation.

Setting or Shaping a mainsail: Other sail stowing systems interfere or restrict the mainsail from being set to achieve optimum shape. Sail Furling Sticks can be stowed in place or removed so as not to interfere with adjusting a main sail's shape for maximum performance.

With other sail furling systems the mainsail when stowed is wrapped or tied with sail ties for prolonged periods in a manner that degrades the sailcloth. For a mainsail this could be as much of 99% of its life.

With Sail Furling Sticks 1 the mainsail 8 when stowed lies folded on the sail sticks 1 the same as it left the sail loft and was folded to go into its sail bag for delivery. This eased stowage will prolong sail performance and life.

There are several advantages to the present design:

Ease of use: The present design is easy to use. The furling sticks 1 and gathering ribs 2 may be easily moved between an stowed position where the furling sticks 1 are pivoted into parallel alignment with a boom 7 and the gathering ribs 2 are folded down against the furling stick 1, and a deployed position where the furling stick 1 is pivoted into perpendicular alignment with the boom 7 and the gathering ribs 2 are extended up and away from the furling stick 1.

Cost: The cost is estimated to be in the range of the price for the least expensive sail furling system (Lazy Jacks). The Sail Furling Sticks will be much less expensive than Stack packs, In-Boom or In-Mast furling systems.

Installation: The installation of the present design is easy and less intrusive that current sail furling systems. Attachment of the Sail Furling Sticks can be adapted to a variety of boom types. The furling sticks requires no permanent mounting brackets or fasteners. They use the boom's sail track in conjunction with the fastening hardware 4, 5 to fasten, retain, and adjust the sail furling sticks as necessary. Thus they can be moved at any time, to any location along the length of the boom. Indeed the sail sticks can be easily and quickly removed from the boom and there will be no holes, or destructive marring of the boom, as evidence of their use.

Aftermarket: The present design can be fitted to any boat, boom or mainsail new or old.

Weight: The present design has a low weight.

Reliable: The system of the present design is simple and not dependent on mechanical gears or wire arrangements.

Other applications: The design lends itself to cockpit and cabin covers when the mainsail is not being used such as when the boat is in a harbor.

The number of sticks required for the system of the present design is dependent on the size of the sailboat and the length of the boom. For example on a J-40, which has a long boom, four sticks seems to be the best arrangement.

A sail furling stick length equals A+ about 10%, where A equals the distance between the adjacent sail slide mast track slugs on the luff of the mainsail.

Each end of the present design has a Gathering Rib 2 that is fastened to the sail furling stick 1. The ribs 2 may be fastened to the furling stick with a bolt 3 and adjusting Grip Knob. This Gathering Ribs 2, when not in use, are folded down parallel along the length of the Sail Furling Stick 1.

When the mainsail 8 is to be stowed, the furling sticks are moved to a deployed position. Prior to lowering of the sail, the furling sticks 1 are rotated 90° so as to be perpendicular to the boom 8. Either before or after rotation of the furling sticks, the gathering ribs 2 are swung up to the vertical position and become perpendicular to the length of its Sail Furling Stick. The gathering ribs 2 act as gatherers to keep the sail in place as it is lowered and then stowed. The angle of the gathering ribs to the furling stick may be other than 90° when the mainsail is to be stowed in further embodiments.

Midway along a Sail Furling Stick 1 is the hardware by which the sail stick 1 is secured to the Boom 7. The fastening hardware (from the top) consists of a threaded Grip Knob 4, connected to a piece of threaded stock. The threaded stock connects to the type of sail slide slug 5 used on that type of boom. It does not matter if the boom sail track is internal or external on the boom. If the design of the boom is such that there isn't a sail slide track then the Sail Furling Sticks can be fastened to the boom drilling and tapping the boom.

The fastening hardware 4, 5 allows for adjustment and/or removal of the Sail Furling Stick 1 at any time. This hardware allows the Sail Furling Stick to be stowed on the boom in parallel or the Sail Furling Stick to be completely removed when the mainsail is in use.

Sail Furling Sticks are temporarily or semi permanently affixed to the boom. They are evenly spaced along the length of the boom, and deployed perpendicular to the boom prior to lowering the mainsail. As if the boom is a spine, the sticks are the ribs, and the furled mainsail the stowed in the chest cavity.

Figure 7:
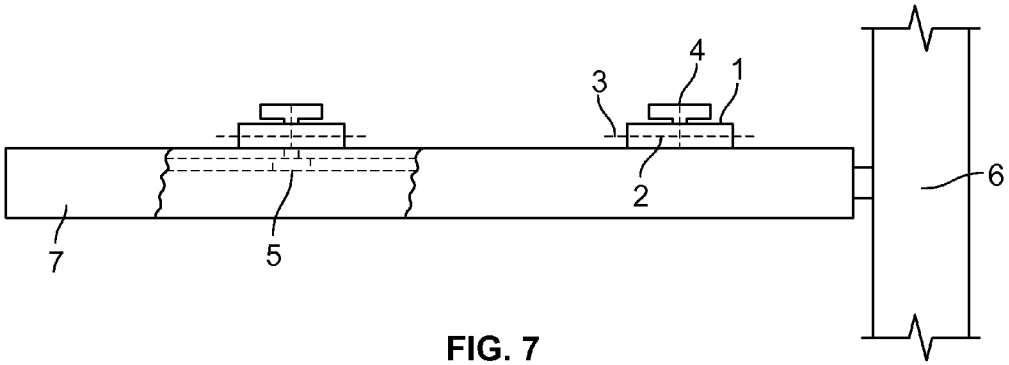
FIG. 7 is a side view of the sail furling stick in a deployed position.
Figure 8:
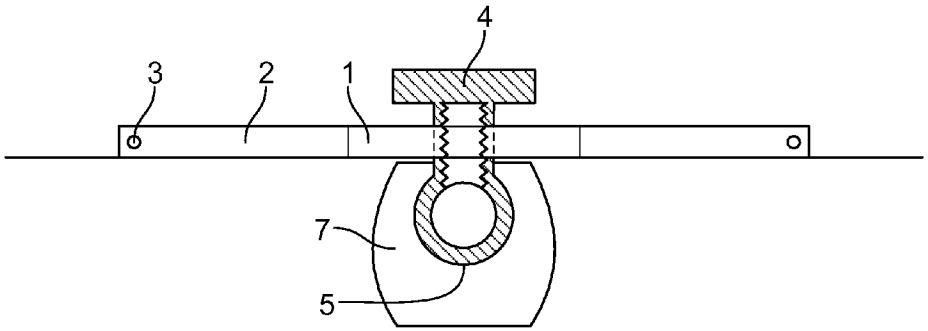
FIG. 8 is a cross-sectional edge view through a boom and furling stick in a partially deployed position.
Figure 6:
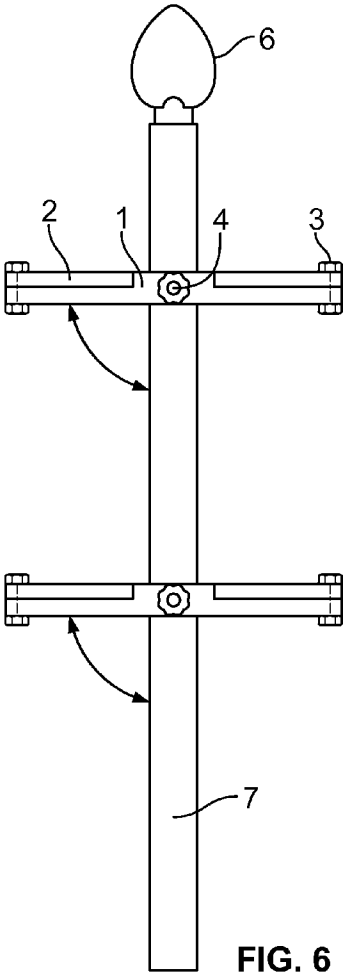
FIG. 6 is a top view of the sail furling stick in the deployed position.
Figure 10:
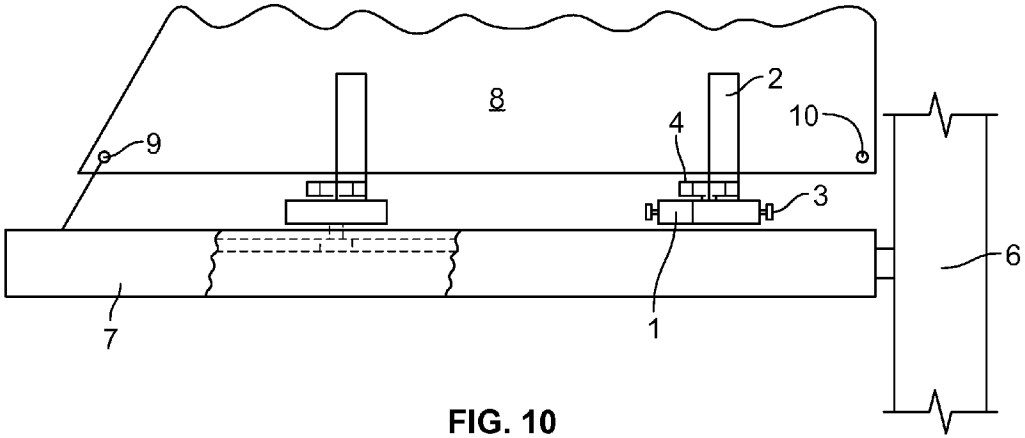
FIG. 10 is a side view of the sail furling stick in a deployed position with gathering ribs oriented upward.
Figure 11:
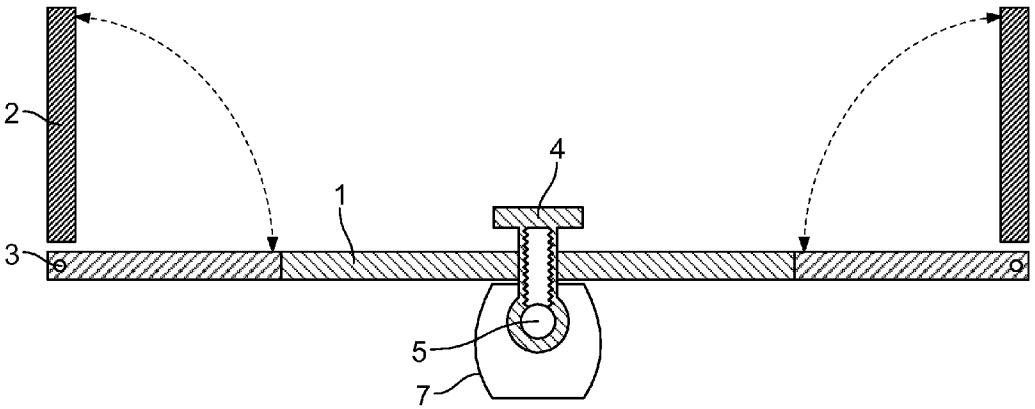
FIG. 11 is a cross-sectional edge view through a boom and furling stick in a deployed position with gathering ribs oriented upward.
Figure 9:
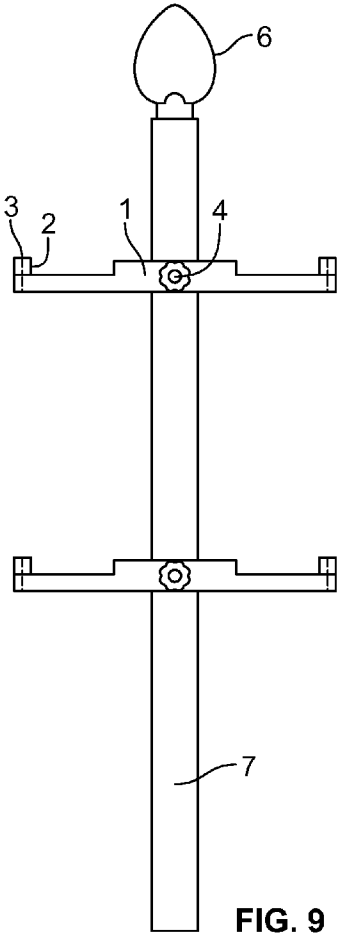
FIG. 9 is a top view of the sail furling stick in a deployed position with gathering ribs oriented upward.

FIGS. 1, 3, 4, and 5 show the furling sticks and gathering ribs in a stowed position where the sail boat is in use and the sail is in its operational position. The furling sticks 1 are parallel with the boom and the first and second gathering ribs are retracted and folded down against the furling stick. FIGS. 6, 7 and 8 show the system moving between a stowed and a deployed position. The furling sticks 1 are rotated 90° to be perpendicular to the boom 8, but the gathering sticks 2 are still in a retracted position against the furling sticks 1.

Figure 12:
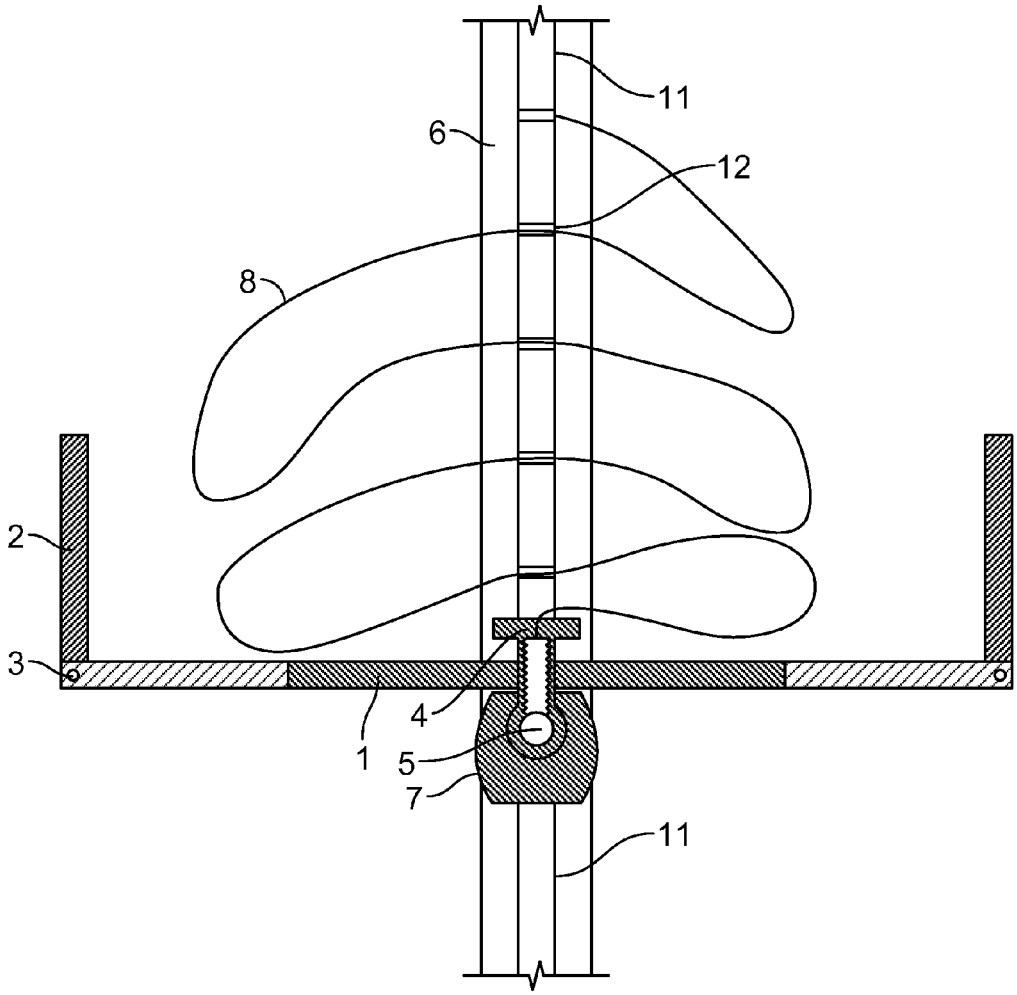
FIG. 12 is a mainsail lowered onto the sail furling stick.
Figure 13:
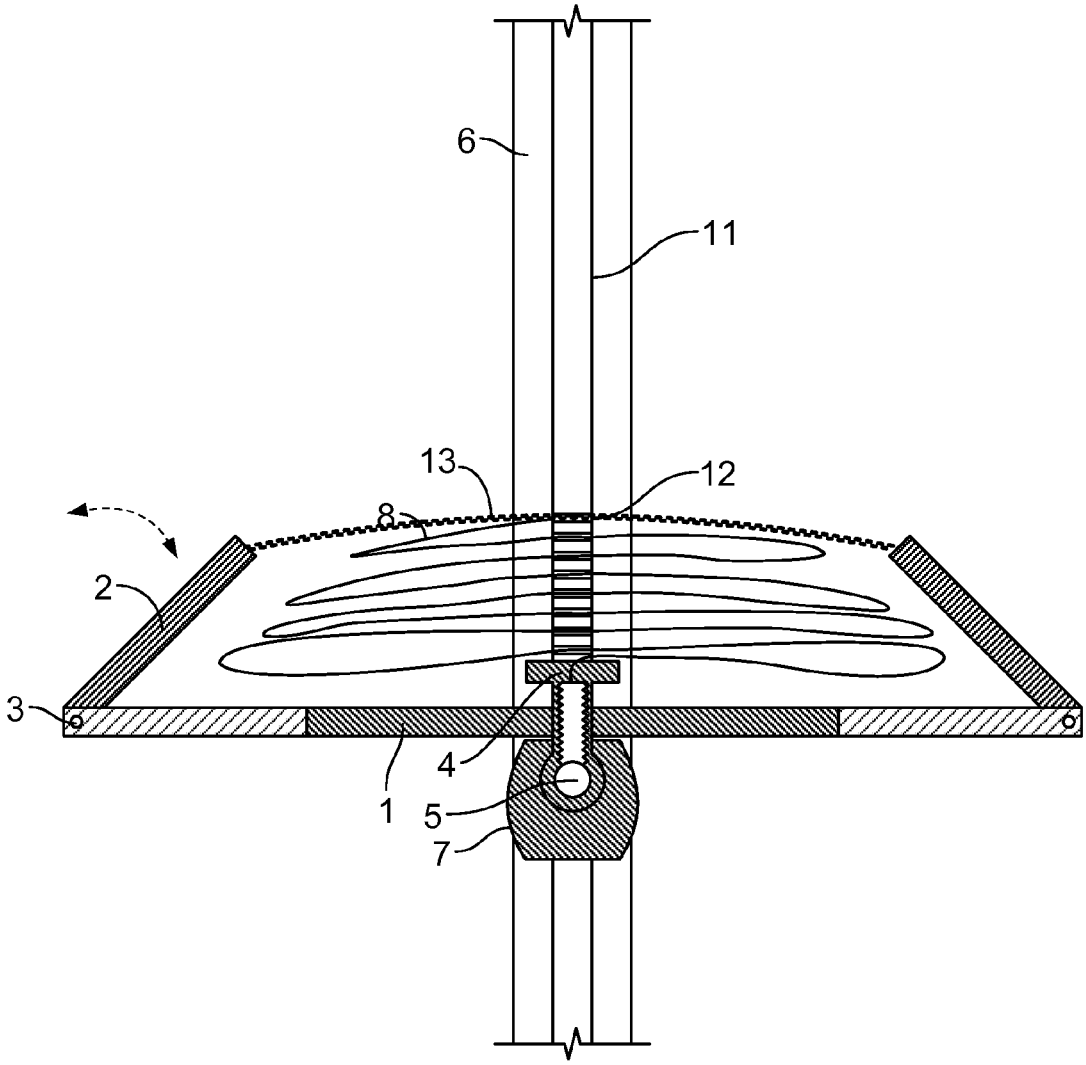
FIG. 13 is the mainsail furled and stowed and secured.

FIGS. 2, 9, 10, 11 and 12 shows the furling stick 1 and gathering ribs in a deployed position where the sail 8 may be stowed against the stick 1 and gathering ribs 2. Referring to FIG. 12, the sail 8, affixed to the mast 6, may be lowered against the furling sticks 1 by lowering the mainsail 8 so that the slide slugs 12 ride within the mainsail track 11 and compress against each other. In this position, the sail 8 is lowered against the furling sticks 1 and gathering ribs 2. As shown in FIG. 13, a line, webbing or bungee cord 13 may then be used to fasten the ends of the gathering ribs together to secure the sail 8.

Figure 14:
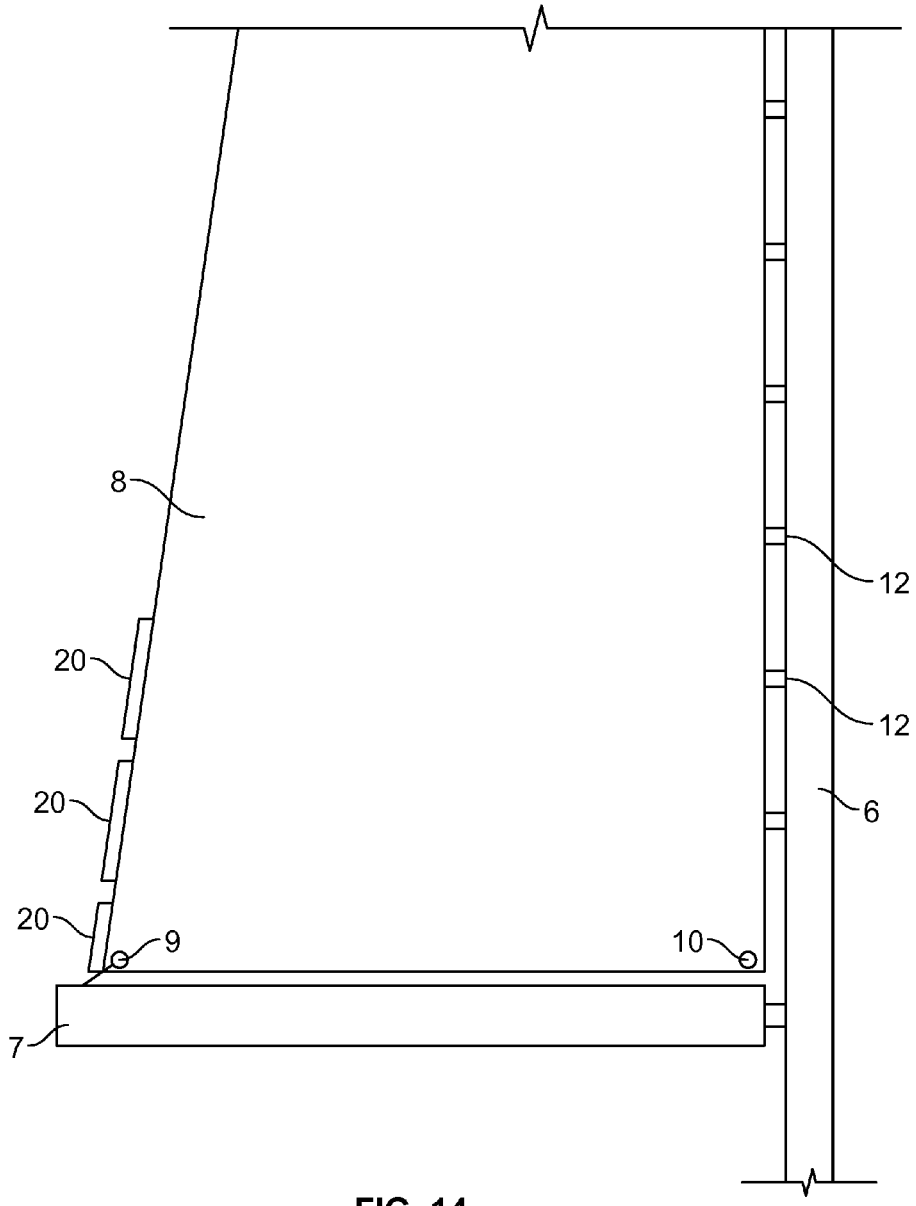
FIGS. 14-16 show mainsail leech sticks.
Figure 15:
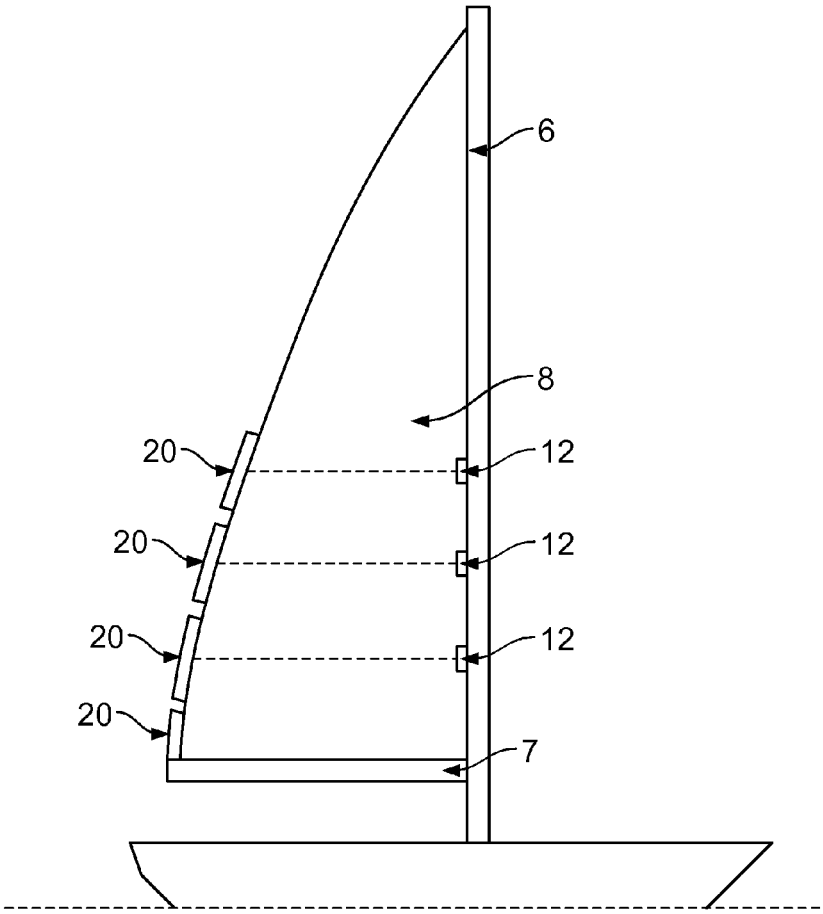
Figure 16:
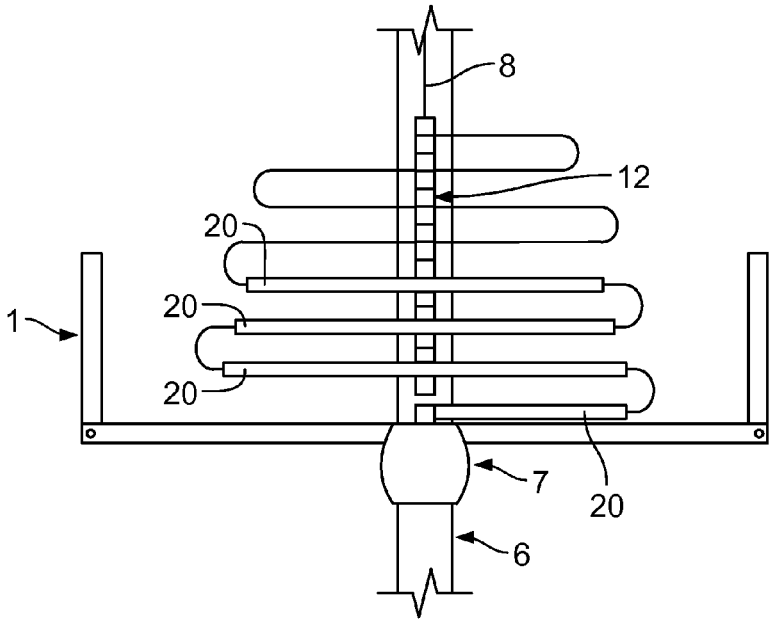

Referring now to FIGS. 14-16, embodiments of the present system may further include leech sticks 20. Leech sticks 20 are rigid sticks affixed in segments to the sail 8. In embodiments, the sticks 20 may be attached to an edge of the sail, but may be elsewhere in further embodiments. As the sail 8 is lowered against the furling sticks 1, the leech sticks 20 define segments at which the sail folds. This facilitates a quick and easy folding of the sail.

Leech sticks 20 can be incorporated into the original design and fabrication of a mainsail, or may be added as an after-market attachment. The leech sticks 20 may be integral or attached within sleeves that run along the after edge or leech of the mainsail.

The leech sticks 20 are designed to function with the sail furling sticks 1 in controlling the mainsail as it is lowered when it is furled. Leech sticks 20 would control the flapping edge or leech of the mainsail, making it fold neatly within the arms of the sail sticks. The leech sticks 20 may be fixed in segments along the edge of the mainsail such that each stick's midpoint along its length may align with its corresponding mainsail luff slide 12 which is attached to the sailboat mast. As the mainsail is raised, the segments of leech sticks unfold with the raised mainsail.

With the mainsail 8 raised, the leech sticks 20 may also be designed to have aerodynamic properties whereby the leech sticks trim angle can controlled to adjust and enhance mainsail foil shape, similar to a trim flap on the wing of an airplane. This control would allow varying adjustment of the leech of the mainsail best suited to the sailboats point of sail.

When the mainsail 8 is lowered, the leech sticks 20 may control the flapping edge of the mainsail. The leech stick articulating segments and their corresponding luff slides 12 would function together to accordion the mainsail down in a controlled manner to lay flat and neat in the arms of the sail furling sticks 1.

The foregoing detailed description of the inventive system has been presented for purposes of illustration and description. It is not intended to be exhaustive or to limit the inventive system to the precise form disclosed. Many modifications and variations are possible in light of the above teaching. The described implementations were chosen in order to best explain the principles of the inventive system and its practical application to thereby enable others skilled in the art to best utilize the inventive system in various implementations and with various modifications as are suited to the particular use contemplated. It is intended that the scope of the inventive system be defined by the claims appended hereto.

What is claimed:

1. A system for furling a sail, comprising:

a furling stick pivotally affixed to a boom, the boom having an axis, the furling stick including first and second ends;

first and second gathering ribs pivotally affixed at the first and second ends, respectively, of the furling stick, the furling stick and first and second gathering ribs moving between a stowed position where the furling stick is parallel with the axis and flat against the boom and the first and second gathering ribs are folded down against the furling stick, and a deployed position where the furling stick is pivoted into perpendicular alignment with the axis of the boom and the first and second gathering ribs are extended up and away from the furling stick.

2. The system of claim 1, further comprising leech sticks mounted on a sail for facilitating stowing of the sail against the furling stick and gathering ribs.

3. The system of claim 1, wherein the furling stick and gather ribs are mounted independently of the sail.

4. The system of claim 1, wherein the sail is received between the first and second gathering ribs with the furling stick and ribs in the deployed position.

5. The system of claim 1, further comprising a line, webbing or bungee cord for constraining the sail between the first and second gathering ribs to secure the sail between the first and second gathering ribs.

6. The system of claim 1, wherein the furling stick is temporarily affixed to the boom.

7. The system of claim 1, wherein the furling stick is permanently affixed to the boom.

8. A system for furling a sail, the sail including a first section along a first peripheral section of the sail and affixed to a boom when the sail is deployed, a second section along a second peripheral section of the sail and affixed to a mast when the sail is deployed, and a third section along a third peripheral section of the sail extending between the first and second peripheral sections, the system comprising:

a furling stick pivotally affixed to a boom, the furling stick including first and second ends;

first and second gathering ribs pivotally affixed at the first and second ends, respectively, of the furling stick;

the furling stick and first and second gathering ribs having a deployed position where the furling stick is perpendicular to the boom and the first and second gathering ribs are extended up and away from the furling stick; and leech sticks mounted along the third peripheral section of the sail for facilitating stowing of the sail against the furling stick and gathering ribs.

9. The system of claim 8, wherein the leech sticks define segments at which the sail folds as the sail is lowered.

10. The system of claim 8, wherein the leech sticks define segments along the edge of the mainsail such that a leech stick's midpoint along its length may align with a corresponding mainsail luff slide attached to the sailboat mast.

11. The system of claim 8, wherein the leech sticks are integrally formed with the sail.

12. The system of claim 8, wherein the leech sticks are affixed in sleeves formed along an edge of the sail.

13. The system of claim 8, wherein the leech sticks comprise three or four leech sticks.

14. The system of claim 8, wherein the leech sticks are adjusted to control a foil shape of the sail.

15. A system for furling a sail, the sail including a first section along a first peripheral section of the sail and affixed to a boom when the sail is deployed, a second section along a second peripheral section of the sail and affixed to a mast when the sail is deployed, and a third section along a third peripheral section of the sail extending between the first and second peripheral sections, the system comprising:

a furling stick gathering the sail upon lowering of the sail; and leech sticks mounted on the third peripheral section of the sail for defining segments at which the sail folds upon stowing of the sail against the furling stick, the leech sticks orienting generally parallel to the furling stick upon folding of the sail.

16. The system of claim 15, wherein the leech sticks define segments along the edge of the mainsail such that a leech stick's midpoint along its length may align with a corresponding mainsail luff slide attached to the sailboat mast.

17. The system of claim 15, wherein the leech sticks are integrally formed with the sail.

18. The system of claim 15, wherein the leech sticks are affixed in sleeves formed along an edge of the sail.

19. The system of claim 15, wherein the leech sticks comprise three or four leech sticks.

20. The system of claim 15, wherein the leech sticks are adjusted to control a foil shape of the sail.

* * * * *